US006263970B1

(12) United States Patent
Blanchet

(10) Patent No.: US 6,263,970 B1
(45) Date of Patent: Jul. 24, 2001

(54) WELLHEAD DEVICE FOR RETAINING THE SOLID PARTICLES CARRIED BY THE PRODUCTION FLUID

(75) Inventor: Charles Blanchet, Bangkok (TH)

(73) Assignee: Total Fina S.A., Puteaux (FR)

( * ) Notice: Subject to any disclaimer, the term of this patent is extended or adjusted under 35 U.S.C. 154(b) by 0 days.

(21) Appl. No.: 09/381,239

(22) PCT Filed: Mar. 17, 1998

(86) PCT No.: PCT/FR98/00536

§ 371 Date: Dec. 8, 1999

§ 102(e) Date: Dec. 8, 1999

(87) PCT Pub. No.: WO98/41732

PCT Pub. Date: Sep. 24, 1998

(30) Foreign Application Priority Data

Mar. 18, 1997 (FR) ..... 97 03269

(51) Int. Cl.[7] ..... E21B 43/34; E21B 33/03; B01D 29/05

(52) U.S. Cl. ..... 166/357; 166/368; 166/75.12; 166/267

(58) Field of Search ..... 166/357, 351, 166/335, 368, 75.12, 81.1, 105.1, 75.11, 267

(56) References Cited

U.S. PATENT DOCUMENTS

| | | | | |
|---|---|---|---|---|
| 1,767,958 | | 6/1930 | Berg . | |
| 1,858,241 | | 5/1932 | Giles . | |
| 3,744,565 | | 7/1973 | Brown . | |
| 3,893,918 | | 7/1975 | Favret, Jr. . | |
| 4,106,562 | | 8/1978 | Barnes et al. . | |
| 5,232,475 | * | 8/1993 | Jepson | 166/267 |
| 6,062,313 | * | 5/2000 | Moore | 166/357 |

FOREIGN PATENT DOCUMENTS

| | | |
|---|---|---|
| 136 369 | 4/1985 | (EP) . |
| 486 976 | 5/1992 | (EP) . |
| 2 676 088 | 11/1992 | (FR) . |
| WO82/04405 | 12/1982 | (WO) . |

* cited by examiner

*Primary Examiner*—David Bagnell
*Assistant Examiner*—Frederick L. Lagman
(74) *Attorney, Agent, or Firm*—Sughrue, Mion, Zinn, Macpeak & Seas, PLLC

(57) ABSTRACT

A wellhead device for the isolation of solid particles carried by production fluid includes a closed housing to be integrated with a wellhead element, a lining tightly fixed on the inner wall of the body producing the fluid upstream of the side outlet(s) provided with the valves, and a cylindrical partition arranged inside the housing around the lining, from which it is separated by a second ring-shaped space. First openings are provided in the upper portion of the partition above the lining, second openings are provided in the lower portion of the partition, and a filter is arranged inside the housing at the periphery of the partition lower portion, opposite the second openings. The filter is arranged such that all the fluid entering through the first partition openings into the volume separating this partition from the housing outer portion passes through the filter before entering the second ring-shaped volume through the partition second openings.

9 Claims, 1 Drawing Sheet

WELLHEAD DEVICE FOR RETAINING THE SOLID PARTICLES CARRIED BY THE PRODUCTION FLUID

FIELD AND BACKGROUND OF THE INVENTION

This invention relates to a device designed to equip the fluid production wellhead, in order to isolate the solid particles carried by this fluid. In particular, the invention relates to a device of this type that can be used for example on a gaseous or liquid hydrocarbon production well, when brought into production, or for the filtering of the completion fluid.

In various situations such as perforations through the "tubing," the start-up of a well or certain areas of a well is accompanied by the production of cuttings and, more generally, solid particles. These may damage the valves of the production shaft and of the production collector, as well as the overall installations through which the fluid circulates. Furthermore, the fluids that are produced (completion fluid, effluent, etc . . . ) must be eliminated or treated while they contain the cuttings or particles.

Therefore, it would be particularly advantageous to have a system that is capable of ensuring the separation by filtration of the fluids that are produced in such situations, even before they pass through the valves of the production shaft, so as to protect the installations through which the fluid travels. In this manner, it would be possible to recycle the completion fluids and send the effluents directly to production.

U.S. Pat. No. 4,106,562 relates to a device for controlling the flow of fluid and debris in a production wellhead that comprises a device for separating and accumulating the debris. The device is comprised of an external housing formed by an accumulation chamber, an evacuation conduit that communicates with the chamber to allow for the passage of the fluid while preventing the passage of debris, and means of accessing it in order to make the periodic removal of accumulated debris easier. The device as set forth in this patent is used in particular to control the flow of fluids coming from a geothermal water vapor production well.

OBJECTS OF THE INVENTION

The purpose of the present invention is to answer this need by proposing a device designed to equip the production wells, upstream from the valves of the production shaft, and to isolate the solid particles present in the produced fluid before it passes through these valves.

SUMMARY OF THE INVENTION

With this end in view, the object of the present invention is a device designed to equip the fluid production wellhead, upstream from the valves through which this fluid passes, in order to isolate the solid particles it carries, where this device comprises:

- a closed casing capable of being made integral with an element of the wellhead;
- a sleeve attached, and made watertight, on the internal wall of fluid the production body upstream from the equipped lateral exit(s) of said valves, where this sleeve is separated from the internal wall of the tube by a first annular space and projects inside the casing so as to lead the fluid produced by the well to it;
- a cylindrical partition arranged inside the casing around said sleeve, from which it is separated by a second annular space, where this partition rests, in a watertight fashion, against the upper part of the sleeve and against the base of the casing and is arranged in such a way in relation to the latter that the first and second annular spaces are in communication;
- the first openings arranged in the upper part of the partition above the sleeve, in order to allow for the passage of the fluid brought through the latter into the volume that separates the partition from the external part of the casing;
- the second openings, arranged in the lower part of the partition, where these second openings are separated, in a watertight fashion, from those arranged in the upper part of this partition and where they allow for the passage of the fluid from the volume that separates the partition from external part of the casing to the second annular space;
- and a filter arranged inside the casing on the periphery of the lower part of the partition, facing the second openings, where this filter is arranged so that all the fluid that enters through the first openings of the partition into the volume that separated this partition from the external part of the casing passes through the filter before entering the second annular volume through the second openings of the partition, the debris and solid matter transported by the fluid that is produced thus being isolated by the filter and settling by gravity at the base of the volume that separates the filter from the external part of the casing.

This device could be mounted by any means known in the field on any wellhead element, for example above the cleaning valve of the production shaft.

The filter could be made of any type of screen and its mesh size will be adapted to the size of the solid particles that we wish to eliminate. Preferably it will be removable.

Advantageously a drilling will be provided on the lower part of the casing to eliminate the debris and solid particles that have accumulated at the base of the volume that separates the partition from the external part of the casing.

The latter may also be equipped with any auxiliary measuring device, for example pressure gauges that make it possible to check the pressure before starting the operations and before dismantling the equipment.

Lifting lugs can be provided on the casing to make it easier to handle the device.

BRIEF DESCRIPTION OF THE DRAWING

The above objective and advantage of the present invention will become more apparent by describing in detail preferred embodiments thereof with reference to the attached drawing in which.

DETAILED DESCRIPTION OF THE PREFERRED EMBODIMENTS

Figure 1:
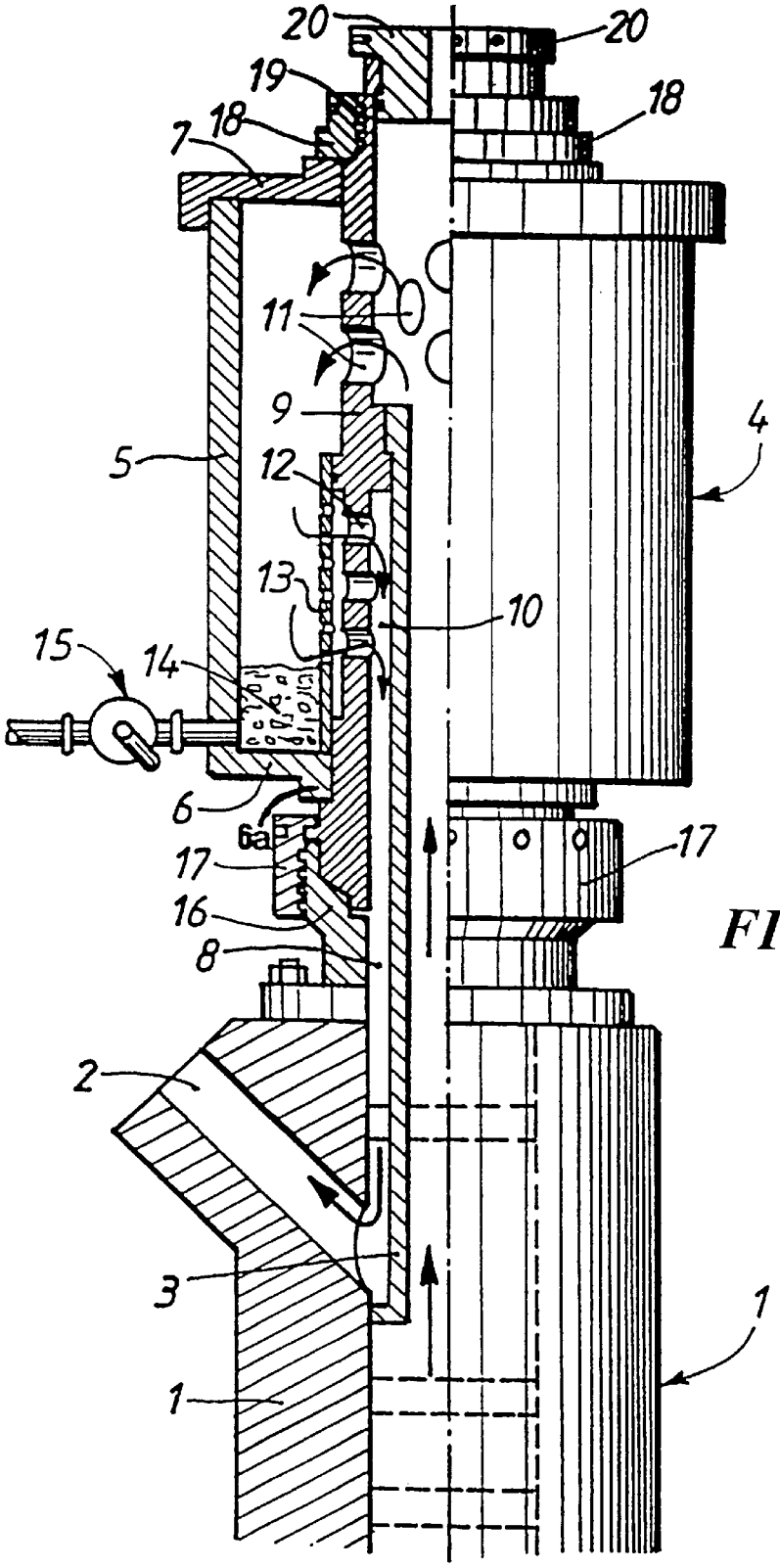
FIG. 1 is a partial vertical axial sectional view of a wellhead equipped with a device for the isolation of solid particles carried by production fluid.

One form of operation of the latter will be described hereafter in further detail, as an example, while referring to FIG. 1, which is a view of a wellhead equipped with a device as set forth in the invention, partially an elevation drawing and partially a vertical axial sectional view.

In FIG. 1, we can see that, on the internal partition of the production body 1, upstream from the lateral exit 2 through which this fluid must pass, is attached a sleeve 3, that projects out of the upper extremity of the body 1, inside a casing 4. This casing 4 comprises a cylindrical body 5, coaxial to the sleeve 3, a base 6, integral with the body 5, and a removable cover 7, that covers the body 5. The sleeve 3 is separated from the body 1 by a first annular space 8, that communicates with the lateral exit 2.

A cylindrical partition 9 is arranged inside the casing 4, on the periphery of the sleeve 3 and coaxial to it, from which it is separated by a second annular space 10, that communicates with the first annular space 8. This partition 9 projects outside of the base of the casing 4, in order make it possible to attach the device on the wellhead, and also outside of the cover 7, to make it possible to attach the latter on the body 5, as will be explained hereafter.

The partition 9 is bored with the first openings 11, above the upper extremity of the sleeve 3, so as to let the fluid brought by the sleeve 3 into the casing 4 through the space that separates the partition 9 from the body 5. On its lower section, the partition 9 is bored with second openings 12, designed to allow for the passing of the fluid into the second annular space from the space that separates the partition 9 from the body 5.

A filter 13 is arranged in the casing 4 on the outside of the cylindrical partition 9, coaxial to it, and facing the second openings 12. This filter 13 rests, in a watertight fashion, against the base 6 of the casing 4 and/or the contiguous part of the partition 9 and against the median of this partition between the openings 11 and 12. It can be held in place in a removable way using collars that encircle it around the protrusions of the partition 9, against which it rests. Before penetrating through the openings 12 into the second annular space 10 and being evacuated through the by-pass 12, the fluid produced by the well must therefore necessarily pass through the filter 13, which isolates the solid particles it may carry. The latter are deposited in 14, on the bottom of the casing 4, and can be evacuated by a drain 15 provided on the lower part of the body 5. As indicated above, the mesh of the sieve 13 is naturally adjusted to the size of the solid particles to be eliminated.

The device can be attached by any means known in the field on an element 16 of the wellhead. In the example described, the element 16 is comprised of a part that is threaded on the outside, on which is screwed a nut 17, that rests on a flange of the lower extremity of the partition 9, below the base 6.

Similarly, a nut 18, screwed on the threaded part 19 of the upper extremity of the partition 9, on the outside of the cover 7, rests on the latter and keeps it resting on the body 5 of the casing 4.

The nut 18 further requires a projecting part 6*a* of the base 6 of the casing 4 that rests against a shoulder or a flange of the partition 9.

As represented, a coupling 20, equipped with an shutter, can be provided on the upper extremity of the partition 9.

The device as set forth in the invention is therefore of great simplicity and acts through a process that is purely mechanical, which makes it particularly well adapted to a use under the harsh operating conditions of hydrocarbon production wells.

What is claimed is:

1. A device designed to equip a fluid production wellhead, upstream from a plurality of valves of a production shaft, through which valves, a fluid carrying solid particles passes, in order to isolate the solid particles, said device comprising:

a closed casing (4) capable of being made integral with an element (16) of the wellhead;

a sleeve (3) capable of being attached in a watertight fashion, to an internal wall of a body (1) that produces the fluid upstream from at least one lateral exit (2) equipped with the valves, where said sleeve (3) is separated from the internal wall of the body (1) by a first annular space (8) and projects inside said casing (4) so as to lead the fluid produced by the wellhead therein;

a cylindrical partition (9) arranged inside said casing (4) around said sleeve (3), from which it is separated by a second annular space (10), where said partition (9) rests in a watertight fashion against an upper part of said sleeve (3) and against a base of said casing and is arranged in such a way in relation to said casing that the first and second annular spaces (8, 10) are in communication;

at least one first opening (11) arranged in an upper part of said partition (9) above said sleeve (3), in order to allow for the passing of the fluid brought through it into a volume that separates said partition (9) from an external part (5) of said casing;

at least one second opening (12) is arranged in a lower part of said partition (9), and said second opening (12) is separated from said first opening (11) arranged in the upper part of said partition and allow for the passing of the fluid from the volume that separates said partition (9) from the external part (5) of said casing (4) toward the second annular space (10);

and a filter (13) arranged inside said casing (4) on the periphery of the lower part of said partition (9) facing said second opening (12), said filter (13) being arranged in such a way that any fluid that penetrates through said first opening (11) of said partition into the volume that separates said partition from the external part (5) of said casing passes through said filter (13) before penetrating into the second annular space (10) through said second opening (12) of said partition, the debris and solid matter carried by the fluid produced thus being isolated by said filter (13) and being deposited through gravity at the base of the volume that separates said filter (13) from the external part (5) of said casing.

2. A device as set forth in claim 1, characterized by the fact that said filter (13) rests in a watertight fashion against the base of said casing (4) and a contiguous part of said partition (9) and against a part of this intermediary partition between said first opening (11) and said second opening (12).

3. A device as set forth in claim 1, characterized by the fact that said filter (13) is mounted in a removable way on said partition (9).

4. A device as set forth in claim 1, characterized by the fact that a drain (15) is provided at the base of said casing (4) to evacuate the solid particles isolated by said filter (13) and deposited on the base (6) of said casing.

5. A device as set forth in claim 1, characterized by the fact that said partition (9) projects outside said casing (4) below the base (6) of said casing and is capable of being made rigidly integral with the element (16) of the wellhead.

6. A device as set forth in claim 5, characterized by the fact that the element (16) of the wellhead comprises a threaded part on which is screwed a nut (17) that rests on a flange of the part of said partition (9) that projects below said casing (4).

7. A device as set forth in claim 1, characterized by the fact that said partition (9) projects outside said casing (4) above a cover (7) that covers said body (5) of said casing, and by the fact that a nut (18), screwed on a threaded part (19) of the projecting part of said partition (9) rests on an external face of the cover (7) to hold it in position.

8. A device as set forth in claim 1, characterized by the fact that the base (6) of said casing (4) comprises a part (6*a*) that projects to the exterior, and is brought to rest on a shoulder or a flange of the part of said partition (9) that projects below said casing (4), by a securing nut (18) of a cover (7).

9. A device as set forth in claim 1, characterized by the fact that said filter (13) rests in a watertight fashion against the base of said casing (4) or a contiguous part of said partition (9) and against a part of this intermediary partition between said first opening (11) and said second opening (12).

* * * * *